US005298705A

United States Patent [19]

Sachs

[11] Patent Number: 5,298,705

[45] Date of Patent: Mar. 29, 1994

[54] SNAP DISK TYPE SWITCH

[75] Inventor: Ekkehard Sachs, Spaichingen, Fed. Rep. of Germany

[73] Assignee: Marquardt GmbH, Rietheim-Weilheim, Fed. Rep. of Germany

[21] Appl. No.: 868,134

[22] Filed: Apr. 14, 1992

[30] Foreign Application Priority Data

Apr. 19, 1991 [DE] Fed. Rep. of Germany ..... 4112754

[51] Int. Cl.[5] ..... H01H 13/26

[52] U.S. Cl. ..... 200/513

[58] Field of Search ..... 200/513

[56] References Cited

U.S. PATENT DOCUMENTS

| | | | |
|---|---|---|---|
| 4,604,509 | 8/1986 | Clancy et al. | 200/513 |
| 4,839,474 | 6/1989 | Hayes-Pankhurst et al. | 200/5 A |
| 4,851,626 | 7/1989 | Nagashima | 200/513 |
| 5,011,728 | 4/1991 | Imae et al. | 428/156 |
| 5,118,909 | 6/1992 | Husting | 200/302.2 |

FOREIGN PATENT DOCUMENTS

| | | | |
|---|---|---|---|
| 3122456 | 5/1982 | Fed. Rep. of Germany . | |
| 3307659 | 9/1984 | Fed. Rep. of Germany . | |
| 3443988 | 6/1985 | Fed. Rep. of Germany . | |
| 3501046 | 7/1985 | Fed. Rep. of Germany . | |
| 8409257 | 9/1985 | Fed. Rep. of Germany . | |
| 3447085 | 7/1986 | Fed. Rep. of Germany . | |
| 3543751 | 7/1986 | Fed. Rep. of Germany . | |
| 3714382 | 11/1987 | Fed. Rep. of Germany . | |
| 3714316 | 11/1988 | Fed. Rep. of Germany . | |
| 3912921 | 12/1988 | Fed. Rep. of Germany . | |
| 3809770 | 10/1989 | Fed. Rep. of Germany . | |
| 3838632 | 7/1990 | Fed. Rep. of Germany . | |
| 8401051 | 3/1984 | PCT Int'l Appl. . | |
| 1453827 | 10/1976 | United Kingdom . | |
| 2062965 | 5/1981 | United Kingdom | 200/513 |
| 2168537 | 6/1986 | United Kingdom . | |

*Primary Examiner*—Renee S. Luebke

*Attorney, Agent, or Firm*—Spencer, Frank & Schneider

[57] ABSTRACT

A pushbutton switch having a frustoconical switch cap of plastic, which acts as a restoring element, is proposed, which switch cap permits a very exact switching operation in comparison with known switch caps of rubber or silicone. In order to achieve optimum switching characteristics with defined switching displacements and forces, a thermoplastic elastomer is used which, as a block copolymer, has special properties regarding the flexibility of the switch cap. In this case, the material selection and dimensions of the switch cap determine the special properties of the pushbutton switch.

17 Claims, 7 Drawing Sheets

SNAP DISK TYPE SWITCH

BACKGROUND OF THE INVENTION

The invention relates to a snap dome type switch which produces substantially the same resetting behavior as a pushbutton switch equipped with a metal disk however at a much lower cost.

PRIOR ART

DE 34 47 085 Al discloses a pushbutton switch of the generic type, which comprises a frustoconical switch cap of synthetic rubber or a plastics molding compound or the like. Such a flexible switch cap is also referred to in the literature as a membrane, bellows or spring element. Similar pushbutton switches are also known from DE 31 22 456 A1 or DE 33 07 659 A1.

As can be seen from the force/displacement diagram of DE 34 47 085 A1 (FIG. 3), when subjected to force, such elastomeric switch caps initially behave in such a way that, up to a maximum force of about 1.5N, there is a virtually linear curve profile (F=f(s)). Thereafter, the flexible conical-surface membrane yields abruptly, so that the required compressive force drops. The force/-displacement curve then rises in parabola form until fixed-contact bridging. Thereafter, a so-called after-travel displacement ensues, which the button also covers after closing in order to ensure that the contacts are definitely closed and are pressed together with adequate contact force.

Also known are pushbutton switches which comprise a convex metal disk, which assume both the function of the bridging contact and of the restoring element. Such metal disks have a smaller pre-travel displacement, but bring about a distinctly more noticeable switching contact. In comparison, switch caps of flexible material behave in a more undefined way and do not bring about such a precise switching operation.

SUMMARY OF THE INVENTION

In comparison with the known pushbutton switches, the pushbutton switch according to the invention has the advantage that a switching element is created which comes close in its switching characteristics to those exhibited by pushbutton switches containing metal disks. In particular, a high service life and reproducibility of the properties of the button are ensured. Together with a very exact switching operation, a small switching displacement for elastomeric switch caps is achieved, with a sufficiently great after-travel, such as is characteristic for such switch caps of elastomeric material.

Customary elastomeric switch caps are produced from natural rubber or else plastic, for example from silicone, by a compression-molding process with subsequent curing. In this process crosslinking of the plastic takes place by heat and the effect of pressure during curing. A crosslinked plastic has in this case a certain degree of shape memory in its deformation, which determines the degree of elasticity of the material.

In comparison, in the case of the pushbutton switch according to the invention, a completely different starting material is used, namely a thermoplastic elastomer, which is processed by the injection-molding process. This dispenses with the need for complicated curing of the known apparatuses to produce crosslinkage. In the case of the pushbutton switch according to the invention, the elasticity is achieved by the material property of the new flexible plastics material, which is known for other applications under the name "HYTREL" of Messrs Du Pont. This is a so-called block copolymer, i.e. a long molecule chain which is built up with a certain ratio of hard and soft segments. The hard segments are formed from a crystalline polybutylene terephthalate and the soft amorphous segments are formed on the basis of long-chain polyether glycols. The elastic properties of the material are determined by the ratio of the hard segments to the soft segments. In the present case, the ratio of the two components is chosen such that a Shore hardness of D=35−40 is obtained.

Consequently, the entire switch cap consists of one and the same material, the elasticity of which is formed by its special properties, the wall thickness of the thin-walled conical-surface membrane in relation to the cone height playing a part in determining the special elastic properties of this part.

The switching behavior of the pushbutton switch according to the invention is also decisively determined by the relationship of the truncated cone height of the flexible thin-walled conical-surface membrane with respect to the overall pushbutton displacement. In order to achieve as precise a switching action as possible, the overall pushbutton displacement is chosen to be slightly less than twice the truncated cone height, the overall pushbutton displacement corresponding approximately to 1.3 to 2 times the flexible truncated cone height.

Further developments and improvements of the pushbutton snap dome switch are specified in the various embodiments of the invention as described herein.

Particularly advantageously, in the case of the switch cap according to the invention, the contact path or the contact surface for fixed-contact bridging may either—as known—be provided on the underside of the cover-shaped truncated cone tip or on an annular surface of the cylindrical ring-shaped base facing the cone tip. In the former case, the contact surface lies underneath the cover-shaped truncated cone tip in the truncated cone, in the latter case the contact surface is arranged as an annular surface around the cover-shaped truncated cone tip outside the truncated cone. This produces a much larger contact surface and consequently a more reliable switching contact.

The switch cap according to the invention in the pushbutton switch can preferably be used in various items of equipment and pushbuttons. For example, two switch caps arranged next to each other on a printed-circuit board can be alternately actuated by means of a rocker-shape-mounted wall switch and initiate different switching pulses.

The switch cap according to the invention may also be arranged on a printed-circuit board and actuated by means of a separate actuating element.

A further development of the invention provides that the switch cap is arranged in a closed housing with a lower housing part and an upper housing part.

In a particular configuration of the invention, the switch caps are connected to each other in one piece by means of a switching mat and are fitted onto a contact wafer.

BRIEF DESCRIPTION OF THE DRAWINGS

Further details of the invention are explained in more detail in the following description, with further advantages being specified, and are represented in the drawing, in which.

DETAILED DESCRIPTION OF THE PREFERRED EMBODIMENTS

Figure 1:
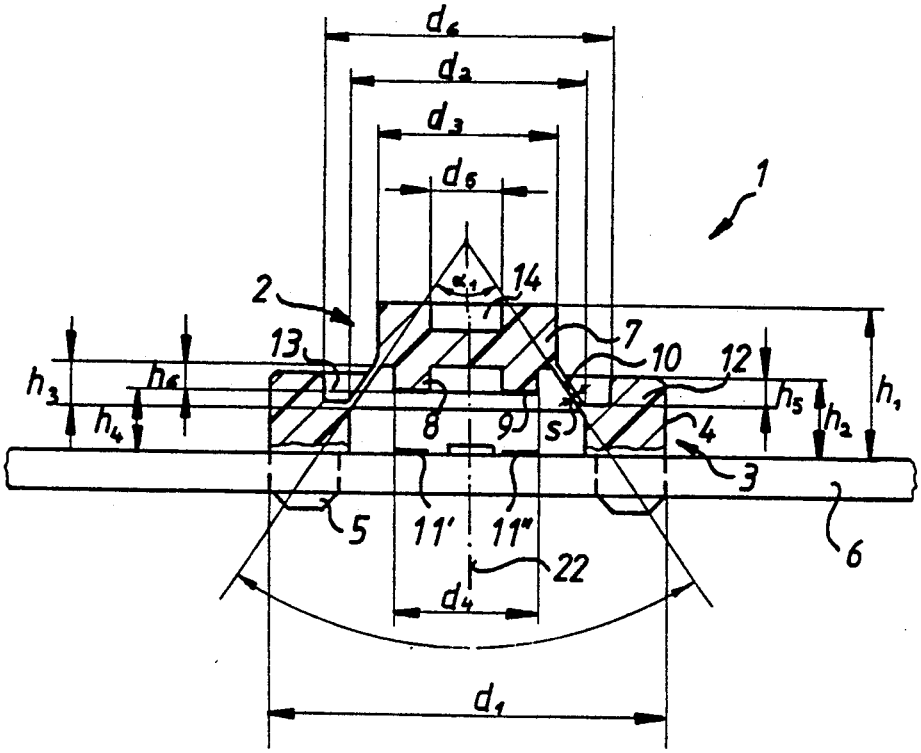
FIG. 1 shows a section view of a switch cap for the pushbutton switch according to the invention on a printed-circuit board.

The pushbutton switch 1 according to the invention, put to use in FIGS. 3 to 6, comprises, according to the embodiment shown in FIG. 1, a frustoconical switch cap 2, also referred to in the literature as a bell-shaped spring element or bellows. The frustoconical switch cap 2 has in FIG. 1 on its lower broader base side 3 a cylindrical ring-shaped base 4, which in the embodiment according to FIGS. 1 and 3 has on its underside insertion feet 5 for inserting into a printed-circuit board 6.

In the upper region of the frustoconical switch cap 2, the latter is formed according to FIG. 1 by a frustocylindrical cover 7, which has on its underside a circular ring-shaped cylinder extension 8 of the height $h_6$, on the lower annular surface of which the contact surface 9 is applied. The applied contact surface may consist of a conductive paste of carbon lacquer, silver conductive lacquer or else gold conductive lacquer.

The base 4 and the cylindrical cover 7 are connected to each other by means of the thin-walled conical-surface membrane 10 of the wall thickness "s". The cone-envelope surface of the membrane 10 is determined by interior the angle $\alpha_1$ as measured at an extended frustum cone apex.

Figure 1A:
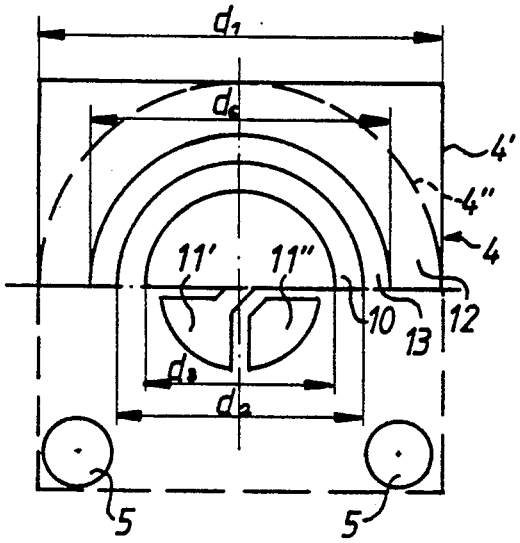
FIG. 1*a* shows a plan view of a switch cap for the pushbutton switch according to the invention on a printed-circuit board.

As represented by the drawing in FIG. 1*a* as a plan view of FIG. 1, the base 4 may have a rectangular basic cross section 4' or a circular cross section 4''. The diameter, or the edge length, is specified in FIGS. 1 and 2 by $d_1$. $d_2$ denotes the outside diameter, $d_3$ the inside diameter of the frustoconical membrane 10. At the same time, $d_3$ forms the outside diameter of the frustocylindrical cover 7. The cylinder extension 8 has a circle diameter $d_4$.

The contact path 9 with the annular surface of the cylinder extension 8 interacts with a fixed contact 11, comprising the contact terminals 11', 11'' on the conductor track 6. By depressing the pushbutton switch, the contact path 9 briefly closes the two fixed contacts 11', 11'' and consequently initiates an electrical contact bridging.

The frustoconical switch cap 2 has an overall height $h_1$, arranged above the printed-circuit board 6, and a base height $h_2$. The height of the conical-surface membrane 10 is $h_3$, the height of the overall pushbutton displacement is $h_4$.

The entire frustoconical switch cap 2 is produced from a flexible plastic, which has become known by the name "HYTREL" of Messrs Du Pont. This is a so-called block copolymer, which comprises a hard, crystalline segment of polybutylene terephthalate and a soft, amorphous segment based on long-chain polyether glycols. Consequently, long molecule chains are formed, which alternately form in each case a fixed element and a flexible element, the flexibility being brought about by the incorporation of the flexible parts. Depending on the ratio of the hard segments to the soft segments, as well as the preparation of the segments, the properties of the flexible plastic are changed to a certain extent. In this case, the elasticity of the material is not formed by a crosslinking of the plastic, as in the case of the known silicone by a curing operation, but by the structure of the block copolymer as such. In the case of the switch cap according to the invention, this ratio is chosen such that a Shore hardness of $D \approx 35-40$ is produced.

In the case of the switch cap according to the invention, the base 4 and the cover 7 are relatively rigid and stiff on account of the solid shaping, whereas the flexible membrane 10 is designed to be very elastic on account of the thin walledness. Production is performed by the injection-molding process, without a subsequent complicated curing being required.

Serving for an additional reinforcement of the base 4 is a cross-sectionally annular additional shoulder 12, which has a height $h_5$ and a circular inside diameter $d_6$ and forms a type of annular depression 13 for the extension of the conical-surface membrane 10. The additional shoulder 12 extends in its outside diameter to the shaping of the base 4 according to FIG. 1*a*, i.e. it is of rectangular or circular design.

Figure 3:
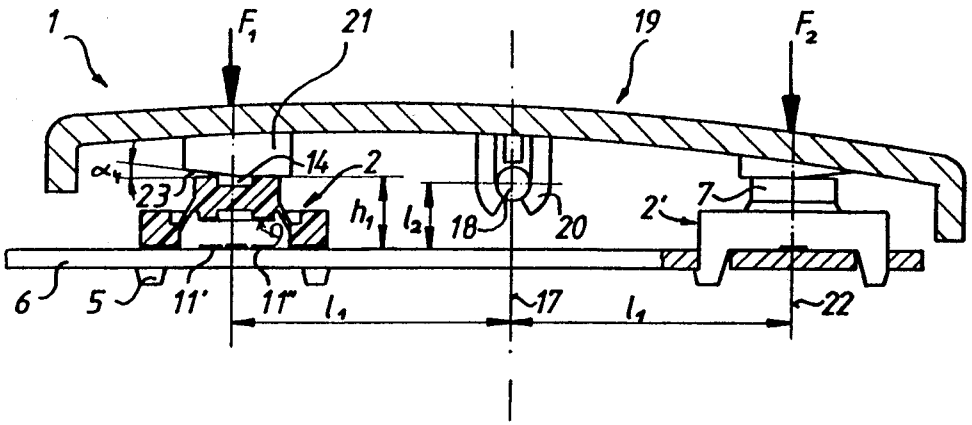
FIG. 3 shows an application of the switch cap according to FIG. 1 in a rocker-shaped wall switch.

The frustocylindrical cover 7 has an upper circular-cylindrical depression 14 of a diameter $d_5$, which serves as connection bore for the wall-switch fastening represented in FIG. 3. The diameter $d_5$ is at the same time the inside diameter of the annular contact path 9 or of the cylinder extension 8.

An illustrative embodiment of the switch cap according to FIG. 1 has, for example, the following expedient values:

| | |
|---|---|
| $d_1$ = 11 mm | $d_2$ = 7 mm |
| $d_3$ = 5 mm | $d_4$ = 4 mm |
| $d_5$ = 2 mm | |
| $h_1$ = 4 mm | $h_2$ = 2.2 mm |
| $h_3$ = 1.2 mm | $h_4$ = 1.6 mm |
| $h_5$ = 0.8 mm | $h_6$ = 0.8 mm |

-continued

| |
|---|
| $\alpha \approx 60°$. |

Figure 2:
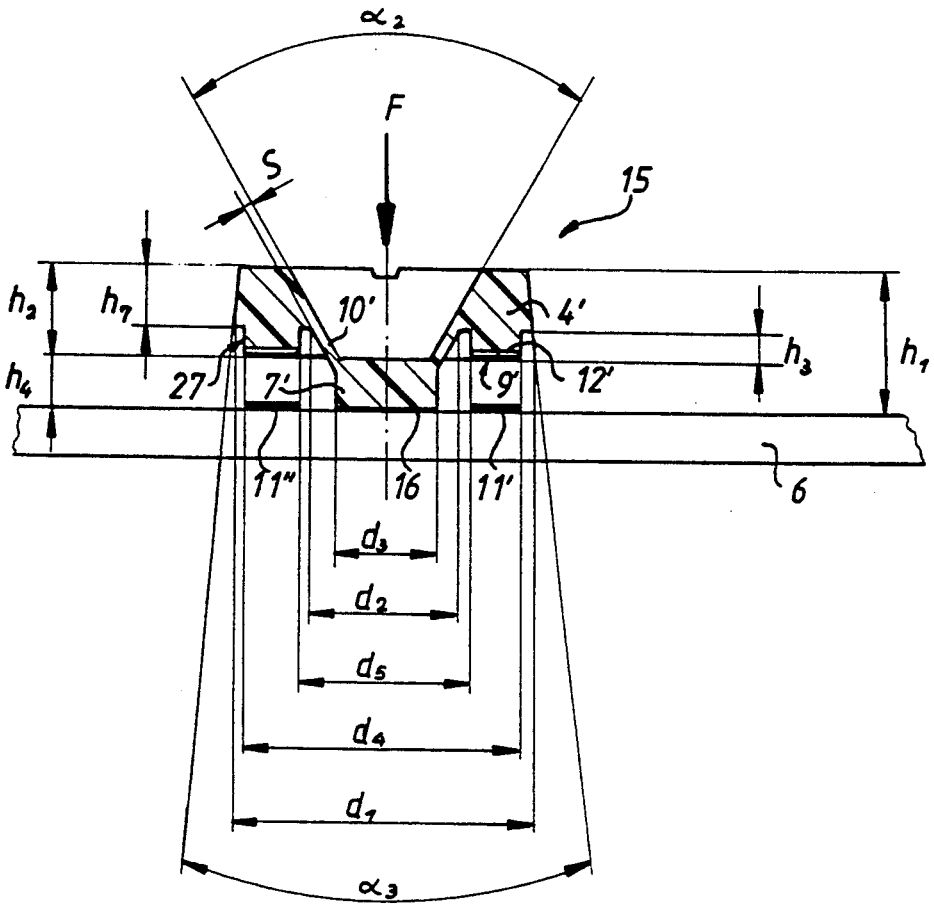
FIG. 2 shows a switch cap with switching contact surfaces on the longitudinally displaceable base.

In the case of the illustrative embodiment of a pushbutton switch according to FIG. 2, the frustoconical switch cap 15 is, as it were, inverted in comparison with the representation in FIG. 1. Consequently, the frustocylindrical cover 7' is fastened with its lower end face 16 on the printed-circuit board 6. The conical-surface membrane 10' opens out upward at an angle $\alpha_2 \approx 60°$ and merges with the corresponding base 4'. The force applied by the force F onto the switch cap 15 represented in FIG. 2 then takes place from above onto the base 4', so that the latter—and not the cover 7 as in FIG. 1—moves towards the printed-circuit board 6.

To establish the switching contact, the base 4' in turn has a cross-sectionally annular additional shoulder 12', which has on its downwardly directed end face the cross-sectionally annular contact path 9'. The contact path 9 then interacts with a fixed contact 11'. 11'', provided on the printed-circuit board 6. These contact surfaces on the conductor track 6 are once again represented reduced in FIG. 2*a*, respectively opposite contact segments 11', 11'' being short-circuited by the contact path 9'.

In FIG. 2, the diameter dimensions and height dimensions—where comparable—are specified by the same reference symbols as in the representation in FIG. 1. The overall height of the switch cap 15 is $h_1$, the height of the base 4' is specified by $h_2$. The height of the conical-surface surface membrane 10' is $h_3$, the height of the overall pushbutton displacement is $h_4$. The installation height of the base 4' up to the snap-in edge 27 is denoted by $h_7$.

Just as in FIG. 1, in FIG. 2 the outside diameter of the switch cap 15 is denoted by $d_1$, the outside diameter of the conical-surface membrane 10' is denoted by $d_2$ and the inside diameter of the conical-surface membrane 10' is denoted by $d_3$. The outside diameter of the contact path 9 has the diameter $d_4$, the inside diameter of the contact path 9' has the diameter $d_5$. The inside diameter $d_3$ of the conical-surface membrane corresponds to the outside diameter of the frustocylindrical cover 7'.

The outer envelope surface of the base 4' is of a slightly conical design and forms an angle of $\alpha_3$.

Figure 2A:
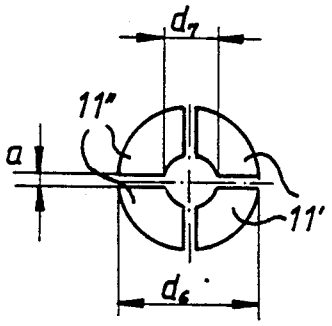
FIG. 2*a* shows the associated contact surfaces on the conductor track in a reduced representation.

In FIG. 2*a*, the outside diameter of the fixed contacts 11', 11'' is specified by $d_6$, the inside diameter is specified by $d_7$. The distance between the individual constant-path segments 11', 11'' is a.

The following values may be assumed in an illustrative embodiment according to FIGS. 2, 2*a*:

| | |
|---|---|
| $h_1 = 2.8$ mm | $h_2 = 1.8$ mm |
| $h_3 = 0.6$ mm | $h_4 = 1$ mm |
| $h_7 = 1.2$ mm | |
| $d_1 = 6$ mm | $d_2 = 3$ mm |
| $d_3 = 2$ mm | $d_4 = 5.5$ mm |
| $d_5 = 3.4$ mm | $d_6 = 6.5$ mm |
| $d_7 = 2.5$ mm | |
| $a = 0.5$ mm | |
| $\alpha_3 \approx 12°$. | |

Figure 2B:
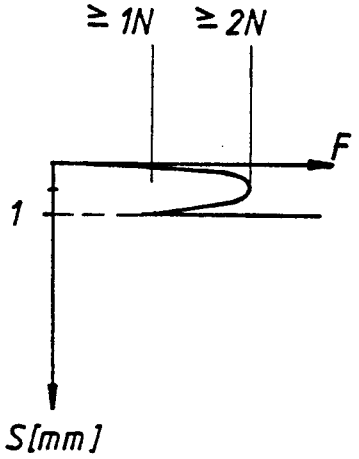
FIG. 2*b* shows a force/displacement diagram of the switch cap according to FIG. 2.

In FIG. 2*b*, the force/displacement diagram for the switch cap 15 is represented diagrammatically. After a displacement of about $s \approx 0.5$ mm, a perceptible switching point is reached at a maximum compressive force of $F \approx 2N$. With a covered displacement $s = h_4 = 1$ mm, the maximum overall pushbutton displacement is passed through with a residual force of $F \approx 1$ N. Then, without covering any further displacement, the force increases to the value applied by the actuator. In FIG. 3, an application example of a pushbutton switch 1 having a frustoconical switch cap, as described in FIG. 1, is represented. For this, two identical switch caps 2, 2' are arranged at a distance $l_1 = 15$ mm from a center line of symmetry 17 on a printed-circuit board 6. In the vertical plane of the center line of symmetry 17 there is, at a distance $l_2 \approx 3.6$ mm from the printed-circuit board 6, a horizontal rocker pivot axis 18 for a wall switch or rocker switch 19 for actuating the two switch caps 2, 2' lying underneath. The wall switch 19 is pivotally clipped by means of splaying hooks 20 onto the rocker pivot axis 18. Between wall switch 19 and switch cap 2, 2' there are actuating blocks 21, which snap into the recesses 14 according to FIG. 1. To the side of the longitudinal axis of symmetry 22 of each switch cap 2, 2', the actuating block 21 is provided with a wedge-shaped recess 23 having a clearance angle $\alpha_4 \approx 6°$. This recess 23 serves for avoiding an excessive tilting motion of the frustocylindrical cover 7 upon actuation of the wall switch 19. It represents a kind of clearance angle.

The wall switch 19 is actuated by alternate actuation of the two switch caps 2, 2' by means of the forces $F_1$ or $F_2$. In the case of actuation, the corresponding electric contacts of the switch caps 2, 2' initiate different signals on the printed-circuit board 6.

Figure 4A:
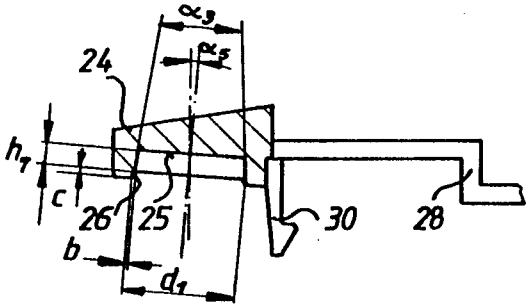
FIG. 4*a* shows an application of the switch cap according to FIG. 2 in a pushbutton switch.
Figure 4:
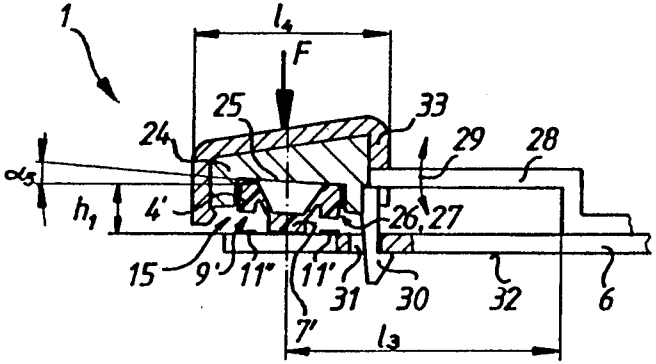
FIG. 4 shows an application of the switch cap according to FIG. 2 in a pushbutton switch.

A pushbutton switch 1 having a switch cap 15 according to the embodiment as shown in FIG. 2 is represented in FIGS. 4, 4*a*. Here, the switch cap 15 is fastened with its downwardly directed, frustocylindrical cover 7' on a printed-circuit board 6. The base 4' of the frustoconical switch cap 15 is embedded in a switch housing 24 having a correspondingly adapted, cylindrical shaped depression 25 and is anchored by means of snap lugs 26. The snap lugs 26 of the housing 24 engage in corresponding recesses 27 (see FIG. 2) of the base 4'. The switch housing 24 is fastened to a cantilever arm or pivot arm 28, which is pivotally mounted by means of the lever arm $l_3$. The pivoting direction is indicated by arrow 29. The upward motion of the switch housing 24 is limited by a hook 30, which protrudes through a bore 31 through the printed-circuit board 6 and supports itself on the underside 32 of the printed-circuit board 6. Also represented in FIG. 4 is the contact path 9' applied to the additional shoulder 12 of the base 4', which path runs against the fixed contacts 11', 11'' on the conductor track 6 when the frustoconical switch cap 15 is compressed. In the opened switch state, the base 4' is arranged here such that it is inclined by an angle $\alpha_5$ with respect to the horizontal, so that, in the case of the downwardly directed pivoting motion, a parallel arrangement with respect to the horizontal is ensured upon contact of the contact path 9 with the fixed contact 11. This angle $\alpha_5$ is about 4°.

The switch housing 24 is provided with an additional protective cap 33, which has a length $l_4 \approx 10.5$ mm and under which there can be arranged an indication of the function to be initiated, which may also be exchangeable.

The lever arm $l_3$ for carrying out the pivoting motion is $l_3 \approx 14.5$ mm.

In FIG. 4*a*, the switch housing 24 for receiving the frustoconical switch cap 15, including the cantilever arm 28 and the supporting hook 30, is represented once again in its important dimensions. The recess 25 corresponds in its dimensions to those of the switch cap, as it is represented in FIG. 2. Consequently, the opening diameter is $d_1 \approx 6$ mm, the height is $h_7 \approx 1.2$ mm. The radial projection b of the snap lugs is $b \approx 0.2$ mm, the axial depth is $c \approx 0.3$ mm. The wedge angle of the base 4' is specified as in FIG. 2 as $\alpha_3 \approx 12°$, the clearance angle $\alpha_5$ as about 4°.

Figure 5:
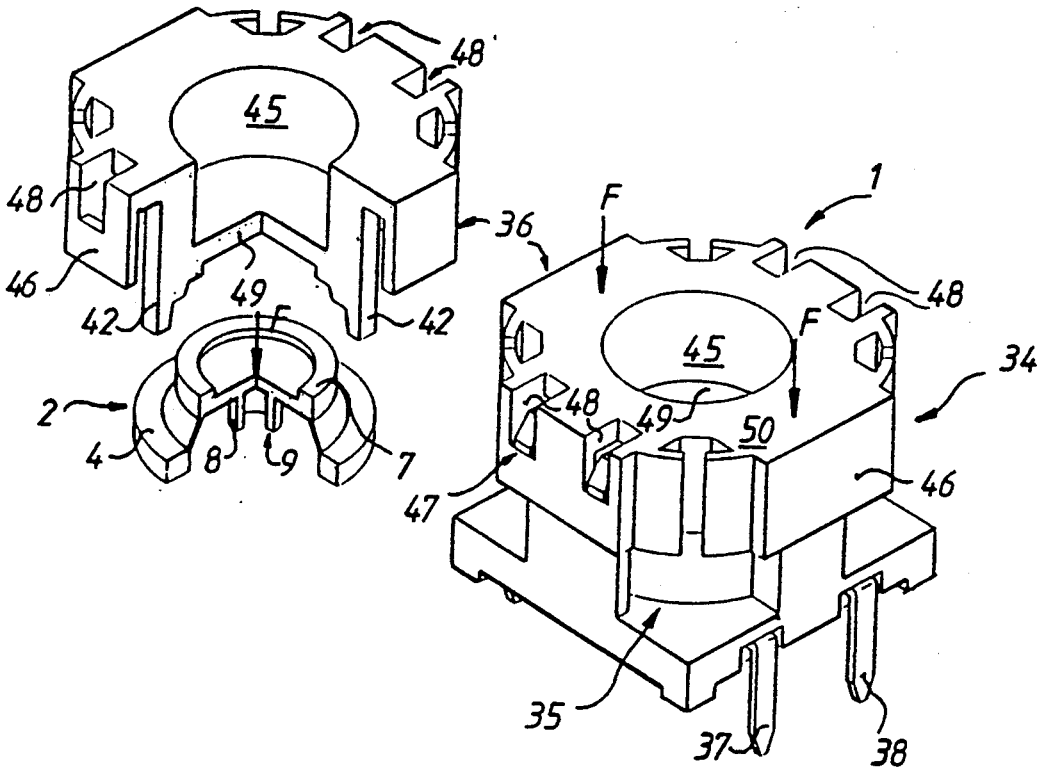
FIG. 5 shows an application of the switch cap according to FIG. 1 in a modified form for use in a pushbutton switch housing in a perspective view.
Figure 5A:
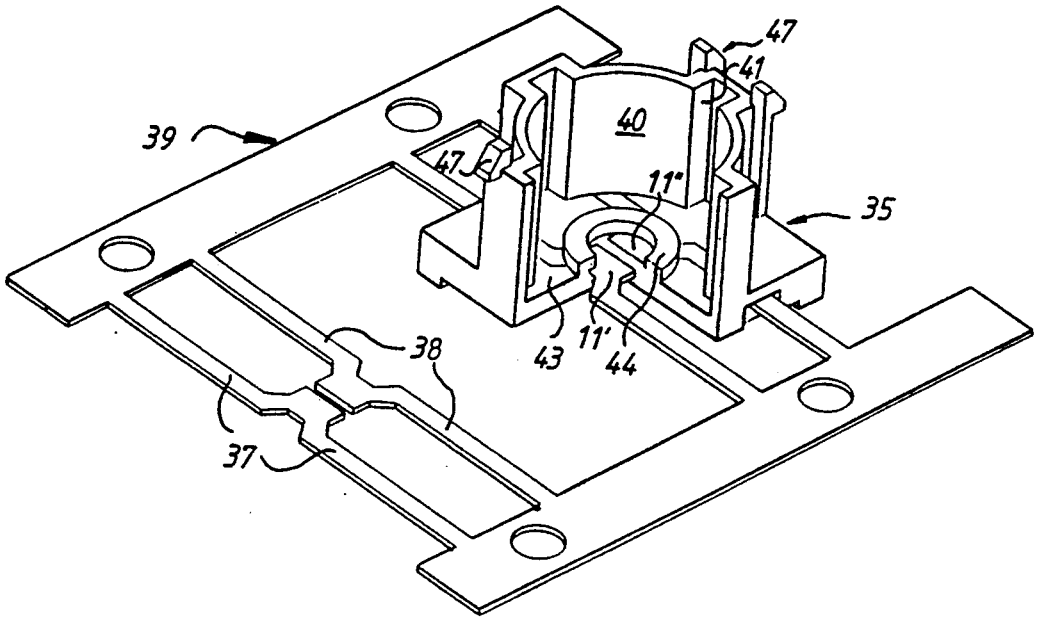
FIG. 5*a* shows an application of the switch cap according to FIG. 1 in a modified form for use in a pushbutton switch housing in an exploded view.
Figure 5B:
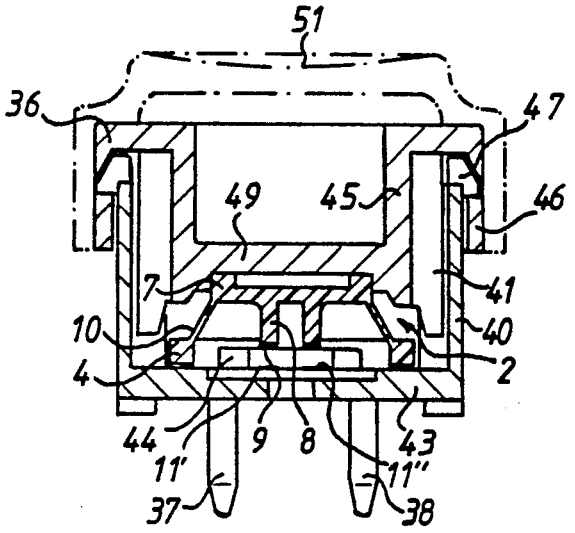
FIG. 5*b* shows an application of the switch cap according to FIG. 1 in a modified form for use in a pushbutton switch housing in a longitudinal sectional view.
Figure 5C:
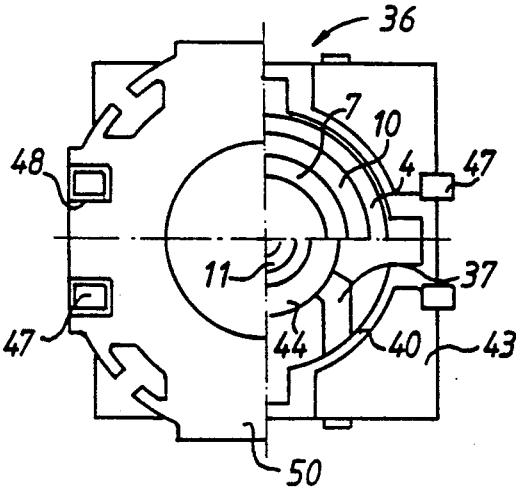
FIG. 5*c* shows an application of the switch cap according to FIG. 1 in a modified form for use in a pushbutton switch housing in plan view.

A further illustrative embodiment of the invention is reproduced in FIG. 5 with individual representations in FIGS. 5*a* -5*c*, FIG. 5*a* representing an exploded representation, FIG. 5*b* a longitudinal section and FIG. 5*c* a plan view. They show a pushbutton switch 1, in which a frustoconical switch cap 2 is arranged in a housing 34 which is closed on all sides. The housing 34 comprises a lower housing part 35 and an upper housing part 36, which enclose the switch cap 2 between them. The lower housing part has a housing base 43 or bottom 43, in which the terminals 37, 38 are molded-in and form an endless strip 39 for automatic assembly. The lower housing part 35 has on its cylindrical inner wall 40 vertical longitudinal grooves 41, which serve as guide grooves for matching longitudinal webs 42 on the upper housing part 36.

The frustoconical switch cap 2 is, in principle, of the same construction as represented in FIGS. 1, 1*a*, alternatively as a circular-cylindrical part (base 4''). However, the insertion feet 5 for a printed-circuit board are missing. The housing base 43 has a circular-cylindrical guide rim 44, which is slightly larger than the diameter $d_4$ in FIG. 1 and on which the base 4 is fitted. Furthermore, the cylinder extension 8 with the contact path 9 fastened thereto on the end face is shown in FIGS. 5*a*, 5*b*. When the switch cap 2 is compressed, the contact path 9 comes into connection with the two fixed contacts 11', 11'' of the electric terminals 37, 38.

The upper housing part 36 is, as it were, of a double-walled design, i.e. it initially slides with an inner cylinder 45 into the inner wall 40 of the lower housing part, the longitudinal webs 42 being guided in the longitudinal grooves 41. With the additional, cross-sectionally largely rectangular outer cylindrical surface 46, the upper housing part 36 engages over the cylinder wall 40, snap-in lugs 47 on the lower housing part 35 engaging and snapping into corresponding recesses 48 on the upper housing part 36.

The frustocylindrical cover 7 of the frustoconical switch cap 2 is subjected by a housing bottom 49 to the force F, which is applied to the upper surface 50 of the upper housing part 36.

In FIG. 5*b*, an additional covering cap 51 for the upper housing part 36 is also shown. Moreover, the pushbutton switch according to the representation of FIGS. 5*b*, 5*c* corresponds to a corresponding sectional representation of the pushbutton switch according to FIGS. 5, 5*a*.

Figure 5D:
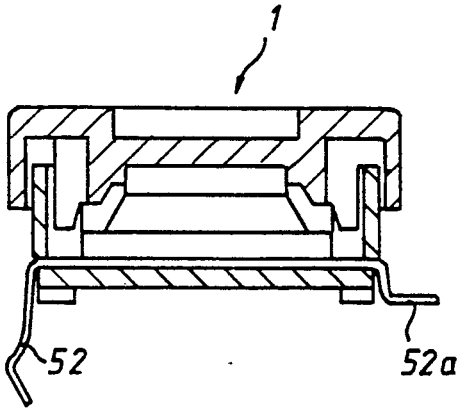
FIG. 5*d*shows a housing form in modification of the representation according to FIGS. 5–5*c*.

In the case of the pushbutton switch according to the representation as shown in FIG. 5*d*, the terminals are configured as solder terminals for printed-circuit boards. A corresponding shaping acts like a pushbutton, so that there is no need for any special holding during soldering. The terminals may also be designed for SMD technology (see reference symbol 52*a*).

Figure 5E:
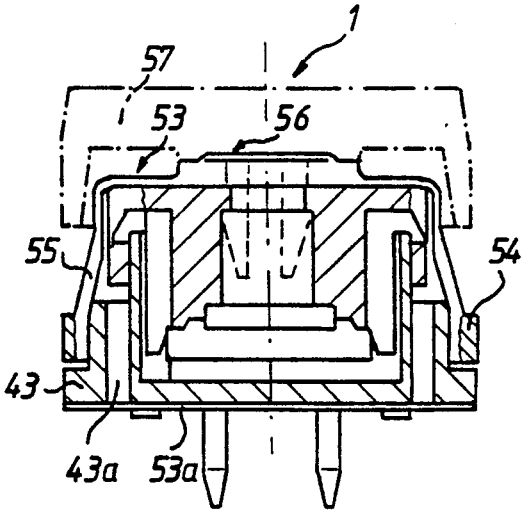
FIG. 5*e* shows another housing form in modification of the representation according to FIGS. 5–5*c*.

The embodiment represented in FIG. 5*e* of a pushbutton switch 1 is designed as a completely sealed-off embodiment. For this purpose, an additional sealing cap 53 with a locking ring 54 is drawn onto a correspondingly shaped base 43. The sealing cap 53 has for this purpose a drawn-down shell region 55. An additional sealing lip 56 on the button receptacle for the actuating button 57 seals off at the push-rod of the upper housing part. The actuating button 57 engages over the sealing cap 53 in the form of a pot. The openings caused during manufacture in the base bottom (43*a*) are sealed off by means of a self-adhesive film (53*a*).

Figure 6A:
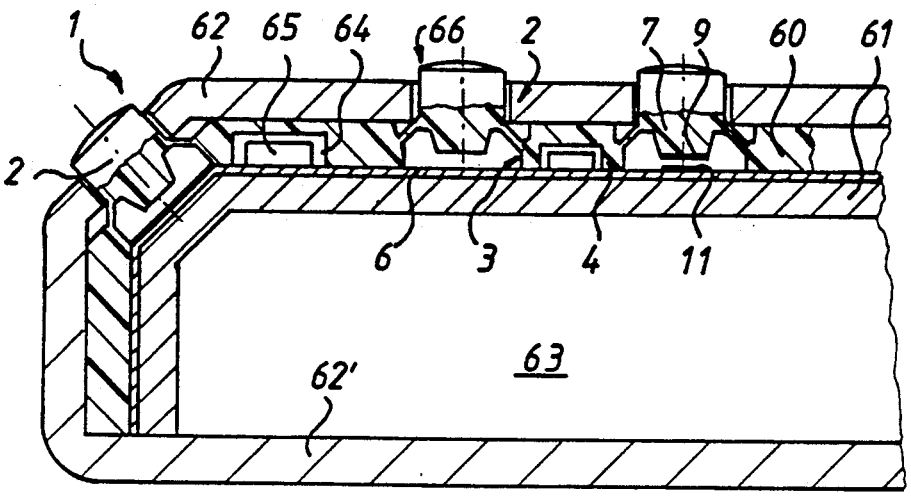
FIG. 6*a* shows an application of the switch cap in a one-piece switching mat configurations.
Figure 6B:
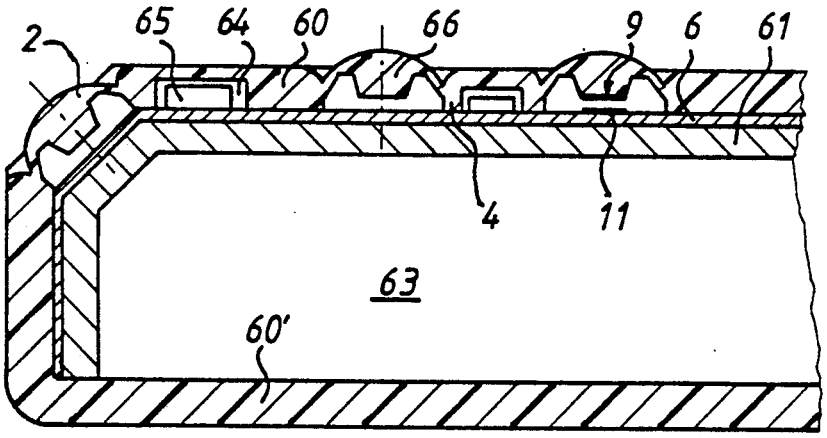
FIG. 6*b* shows another application of the switch cap in a one-piece switching mat configuration.

The embodiment of the invention according to FIGS. 6*a*, 6*b* shows a pushbutton switch in the arrangement for a switching mat of plastic. For this purpose, a multiplicity of identical pushbutton switches 1 having associated frustoconical switch caps 2 are integrated in one piece in a switching mat 60. The frustoconical switch caps 2 are designed on their base sides 3 as bases 4 in such a way that all bases 4 are connected to one another by means of a mat 60. The switching mat 60 is in this case produced from the same material as the bases 4 or the entire switch cap 2. The one-piece switching mat 60 produced in this way is placed onto a printed-circuit board 6, which for its part rests on a housing bottom 61. In the case of the illustrative embodiment according to FIG. 6*a*, the switching mat 60 is covered by an additional outer housing 62. The housing bottom 61 may be widened to form a closed inner housing, as a result of which an inner space 63 for receiving, for example, a power source is produced. Furthermore, the inner housing 61 may itself be fitted with additional conductor tracks and components, such as resistors, by thick-film technology. In FIG. 6*a*, the outer housing 62 is drawn around at the sides to the bottom and forms a housing bottom 62'. In FIG. 6*b*, the switching mat 60 with the integrated switch caps 2 is drawn around the housing wall 61 at the sides and extended as bottom 60', of the arrangement.

The switch caps 2 of the configurations according to FIGS. 6*a*, 6*b* are, in principle, of the same construction as the switch cap according to the description referring to FIG. 1, the individual switch caps however being connected to one another by means of their bases 4 to form a switching mat. The switching mat then rests on a printed-circuit board 6. The switching mat 60 may have recesses 64 for receiving passive or active devices 65 (SMD technology).

The illustrative embodiments represented in FIGS. 6*a*, 6*b* may, for example, represent housings for a remote control for a TV set. In this case, the switch caps 2 serve for actuating the functions. According to the representation in FIGS. 6*a*, 6*b*, the actuating buttons 66 of the switch caps 2 may be differently designed. For instance, the actuating button 66 in FIG. 6*a* corresponds to a cylindrical pushbutton, which protrudes through the upper housing 62 and acts on the upper cover 6 of the switch cap 2. By contrast, the actuating button 66 in FIG. 6*b* is designed in the manner of a spherical knob, since the associated switching mat 60 is directly adjoining. The actuating button 66 with switch caps 2 may also be arranged at the sides of the housing.

The invention is not restricted to the illustrative embodiments represented and described. Rather, it also comprises all the further developments and refinements which a person skilled in the art can accomplish without involving an independent inventive step.

I claim:

1. A snap dome type push button switch suitable for use as an actuating member for bridging fixed contacts as well as a resetting element and comprised of a block copolymer produced by an injection molding process, said block copolymer being comprised in part of a hard crystalline segment of polybutylene terephthalate and in part of a soft, amorphous segment based on long-chained polyether glycols, with a ratio of hard to soft segments of the block copolymer being selected in such a manner that a Shore hardness of $D \approx 35$ to 40 results, said switch comprising:

a switch cap having a shape of a conical frustum including: a broad base having a cylindrical ring shape, a narrow conical frustum tip having a frustocylindrical cover, and a thin-walled flexible cone face membrane connecting said base and said cover, said base and said frustocylindrical cover being made rigid in relation to said membrane, said cone face membrane having a wall thickness s and a height $h_3$, where $s \approx 0.1$ to 0.3 mm and a ratio of the height $h_3$ of the membrane to a switching stroke displacement $h_4$ being $h_3$: $h_4 \approx 1:1.3$ to 2, with a surface of the cone face membrane being determined by an angle $\alpha_1$ of approximately 60° measured at a projected conical frustum apex.

2. The switch as claimed in claim 1, wherein the frustocylindrical cover on the conical frustum tip has on its underside an electrical contact path or a contact surface for bridging fixed contacts, it being possible to press the cover into a frustoconical cavity of the pushbutton switch to carry out the switching stroke displacement.

3. The switch as claimed in claim 1, wherein the frustoconical switch cap has a travel distance of about $h_4 \approx 1$ mm before making electrical contact with a maximum initiating compressive force of $F \approx 2$ N with an after travel of about $\frac{1}{3}$ of the travel distance.

4. The switch as claimed in claim 1, wherein two frustoconical switch caps are arranged next to each other at a distance on a printed-circuit board, wherein a horizontal pivot bearing a rocker switch is provided between the switch caps and wherein either switch cap, can be subjected to a switching force $F_1$, $F_2$ by means of the rocker switch.

5. The switch as claimed in claim 1, wherein the frustoconical switch cap is connected at said base to a printed circuit board, wherein said cover is displaceable for fixed contact bridging.

6. The switch as claimed in claim 1, wherein the frustoconical switch cap is connected at a bottom surface of said frustoconical cover to a printed circuit board, wherein said base is displaceable for fixed contact bridging.

7. A switch, in particular as claimed in claim 1, wherein said cylindrical ring-shaped base of the frustoconical switch cap has on its annular surface facing the conical frustum tip a contact surface for bridging fixed contacts and wherein a direction of the switching stroke displacement of the switch cap, in particular through the base, takes place in a direction of the conical frustum tip.

8. The switch as claimed in claim 7, wherein the frustoconical switch cap is mounted with its broader base in a pushbutton switch housing and is fastened with its frustocylindrical cone cover on a printed-circuit board and wherein the actuation of the pushbutton switch housing results in an axial displacement of the base with respect to the printed-circuit board perform fixed-contact bridging.

9. The switch as claimed in claim 8, wherein the pushbutton switch housing is mounted pivotally on the printed-circuit board by means of a lever arm, a hook preferably being provided for travel limitation.

10. The switch as claimed in claim 1, wherein the frustoconical switch cap can be inserted in a cylindrical housing with a cylindrical lower housing part having a base in which electric fixed-contact terminals are molded therein, wherein an associated cylindrical upper housing part can enter axially into the cylindrical lower housing part for actuating the cover of the switch cap, the upper cylindrical housing part preferably having an outer envelope surface surrounding at least a portion of the lower housing part.

11. The switch as claimed in claim 10, wherein the lower housing part has longitudinal grooves and the upper housing part has matching guide webs for a housing guidance, snap-in lugs of the lower housing part snapping into corresponding recesses in the upper housing part.

12. The switch as claimed in claim 10, wherein the upper housing part is designed as a press-actuating element for the switch cap.

13. The switch as claimed in claim 10, wherein the electric fixed-contact terminals are molded into the housing base of the lower housing part as terminal leads and form an endless strip for automatic assembly.

14. The switch as claimed in claim 1, wherein a plurality of frustoconical switch caps having individual bases may be embedded in a sheet-like switching mat of plastic, wherein said mat can preferably be laid on a printed-circuit board, an individual switch cap and an associated actuating member being connected in one piece to the switching mat.

15. The switch as claimed in claim 14, wherein the switching mat with integrated frustoconical switch caps are connected to at least one of an outer housing or an inner housing, a printed-circuit board being arranged between inner housing and switching mat.

16. The switch as claimed in claim 14, wherein the cover of the frustoconical switch cap is designed as a press-actuating element.

17. The switch as claimed in claim 14, wherein the switching mat has cavities for passive or active devices.

* * * * *